US011668530B2

(12) United States Patent
Kobayashi et al.

(10) Patent No.: US 11,668,530 B2
(45) Date of Patent: Jun. 6, 2023

(54) OIL COOLER

(71) Applicants: MAHLE Japan Ltd., Tokyo (JP); MAHLE INTERNATIONAL GmbH, Stuttgart (DE)

(72) Inventors: Hirotaka Kobayashi, Fujimi (JP); Yasuaki Suzuki, Asaka (JP); Masahiro Ariyama, Yokohama (JP)

(73) Assignees: MAHLE INTERNATIONAL GMBH, Stuttgart (DE); MAHLE JAPAN LTD., Tokyo (JP)

( * ) Notice: Subject to any disclaimer, the term of this patent is extended or adjusted under 35 U.S.C. 154(b) by 556 days.

(21) Appl. No.: 16/815,229

(22) Filed: Mar. 11, 2020

(65) Prior Publication Data

US 2020/0208917 A1 Jul. 2, 2020

Related U.S. Application Data

(62) Division of application No. 14/972,496, filed on Dec. 17, 2015, now Pat. No. 10,619,935.

(30) Foreign Application Priority Data

Dec. 26, 2014 (JP) ..... 2014-264673

(51) Int. Cl.
*F28D 9/00* (2006.01)

(52) U.S. Cl.
CPC ..... *F28D 9/0093* (2013.01); *F28D 9/005* (2013.01); *F28D 9/0056* (2013.01)

(58) Field of Classification Search
CPC .... F28D 9/0018; F28D 9/0012; F28D 9/0068; F28D 9/0006; F28D 9/0062; F28D 9/02; F28D 9/0056; F28D 9/005; F28D 9/00; F28F 3/08; F28F 3/12; F28F 3/00; F28F 3/04; F28F 27/02
See application file for complete search history.

(56) References Cited

U.S. PATENT DOCUMENTS

| | | | | |
|---|---|---|---|---|
| 5,964,283 | A | 10/1999 | Pavlin | |
| 10,619,935 | B2 * | 4/2020 | Kobayashi | F28D 9/0056 |
| 2010/0206516 | A1 | 8/2010 | Muller-Lufft et al. | |
| 2012/0325446 | A1 | 12/2012 | Wakamatsu et al. | |

FOREIGN PATENT DOCUMENTS

| | | | | |
|---|---|---|---|---|
| DE | 19654365 | A1 | 6/1998 | |
| DE | 10049890 | A1 * | 4/2002 | F28D 9/005 |
| JP | 09-292193 | A | 11/1997 | |
| JP | 2001-248996 | A | 9/2001 | |

* cited by examiner

*Primary Examiner* — Harry E Arant
(74) *Attorney, Agent, or Firm* — Foley & Lardner LLP

(57) ABSTRACT

Oil cooler is provided to include: a number of core plates each of which has three oil pass holes where oil flows and three cooling water pass holes where cooling water flows; heat-exchanging section where core plates are laminated to define inter-plate oil flow passage and inter-plate cooling water flow passage alternately between an adjacent pair of core plates, in which oil and cooling water can mutually independently flow in direction perpendicular to core plate lamination direction while changing its flow direction by U-turn thereby proceeding in core plate lamination direction as a whole; one end part located at one side of core plate lamination direction and provided with both oil inlet and oil outlet; and the other end part located at the other side of core plate lamination direction and provided with both cooling water inlet and cooling water outlet.

2 Claims, 8 Drawing Sheets

OIL COOLER

CROSS REFERENCE TO RELATED APPLICATIONS

This application is a divisional of application Ser. No. 14/972,496, filed Dec. 17, 2015, which is based upon and claims the benefit of priority from Japanese Application No. 2014-264673, filed Dec. 26, 2014, the entire contents of all of which are incorporated herein by reference.

BACKGROUND OF THE INVENTION

This invention relates to improvements in a multilayered type oil cooler used for cooling a lubricating oil in an internal combustion engine, a hydraulic oil in an automatic transmission or the like.

For example, in Patent Documents 1 and 2, there is disclosed a heat exchanger taking on such a structure that a plurality of plates are laminated and first fluid paths through which a first fluid flows and second fluid paths through which a second fluid flows are alternately formed thereby achieving heat exchange between both of the fluids.

Patent Document 1: Japanese Patent Application Publication No. 1109-292193

Patent Document 2: Japanese Patent Application Publication No. 2001-248996

SUMMARY OF THE INVENTION

However, drawbacks have been encountered in the above discussed conventional oil cooler. More specifically, in the case of increasing the amount of exchanged heat in the technique as disclosed by Patent Documents 1 and 2, the number of laminated plates should necessarily be increased. However, a more increased number of laminated plates brings about a more pressure loss and more reduction of the flow velocities of the first and second fluids, so that increasing the number of plates does not necessarily result in a commensurate effect of enhancing the amount of exchanged heat.

Additionally, in the conventional heat exchanger as disclosed in Patent Documents 1 and 2, an inlet portion of the heat exchanger for the first fluid and an outlet portion of the heat exchanger for the first fluid are respectively disposed at both ends of the heat exchanger of the plate lamination direction, while an inlet portion of the heat exchanger for the second fluid and an outlet portion of the heat exchanger for the second fluid are disposed respectively at both ends of the heat exchanger of the plate lamination direction.

In most of the vehicle-mounted heat exchangers, a low temperature-side medium (fluid) such as a cooling water is delivered through a hose etc. connected to the heat exchanger while a high temperature-side medium (fluid) such as oil is directly delivered from an engine block, a transmission case etc. to a passage port attached onto a base portion of the heat exchanger. Such a configuration that the parts at which each medium (fluid) is delivered are separately disposed at both ends of the plate lamination direction is not preferable from the viewpoint of the layout at the time of being mounted on a vehicle.

Thus the conventional heat exchangers have been susceptible to further improvement in heat-exchanging efficiency and layout flexibility.

An aspect of the present invention resides in an oil cooler comprising: (i) a number of core plates each of which has three oil pass holes where oil flows and three cooling water pass holes where cooling water flows; (ii) a heat-exchanging section where the core plates are laminated to define an inter-plate oil flow passage and an inter-plate cooling water flow passage alternately between an adjacent pair of the core plates, in which oil and cooling water can mutually independently flow in a direction perpendicular to a core plate lamination direction while changing its flow direction by a U-turn thereby proceeding in the core plate lamination direction as a whole; (iii) one end part located at one side of the core plate lamination direction and provided with both an oil inlet for introducing oil into the heat-exchanging section and an oil outlet for draining oil out of the heat-exchanging section; and (iv) the other end part located at the other side of the core plate lamination direction and provided with both a cooling water inlet for introducing cooling water into the heat-exchanging section and a cooling water outlet for draining cooling water out of the heat-exchanging section.

According to the present invention, the oil cooler is provided in such a manner that the oil inlet and the oil outlet are disposed intensively at one end part in the core plate lamination direction while the cooling water inlet and the cooling water outlet are disposed intensively at the other end part in the core plate lamination direction. Furthermore, a plurality of oil flow passages are connected to each other in series and a plurality of cooling water flow passages are connected to each other in series, in which arrangement oil and cooling water can mutually independently flow in a direction perpendicular to the core plate lamination direction while changing its flow direction by a U-turn thereby proceeding in the core plate lamination direction as a whole. With this, it becomes possible to ensure an excellent amount of exchanged heat between oil and cooling water with a small number of core plates while keeping their flow velocities from reducing.

In other words, it is possible to enhance a heat-exchanging efficiency while improving layout flexibility at the time of being mounted on a vehicle.

DETAILED DESCRIPTION OF THE INVENTION

Referring now to the accompanying drawings, some embodiments of an oil cooler according to the present invention will specifically be discussed. In the following description, there will be used the terms "upper", "lower", "top", "bottom" etc. with respect to the posture as shown in FIG. 1 for convenience in explanation; however, the invention is not limited to the illustrated embodiments.

Figure 1:
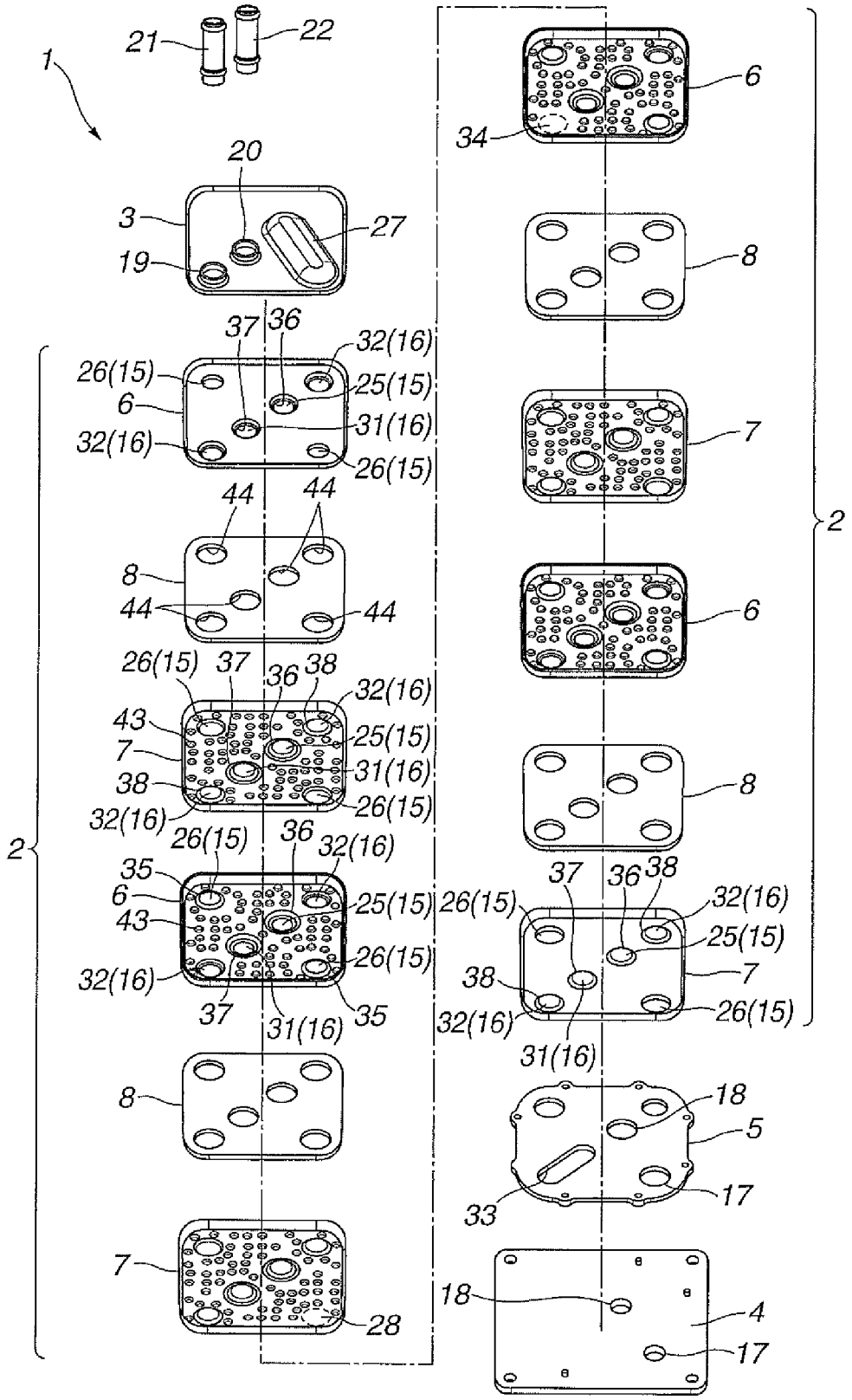
FIG. 1 is an exploded perspective view of a first embodiment of an oil cooler according to the present invention.
Figure 2:
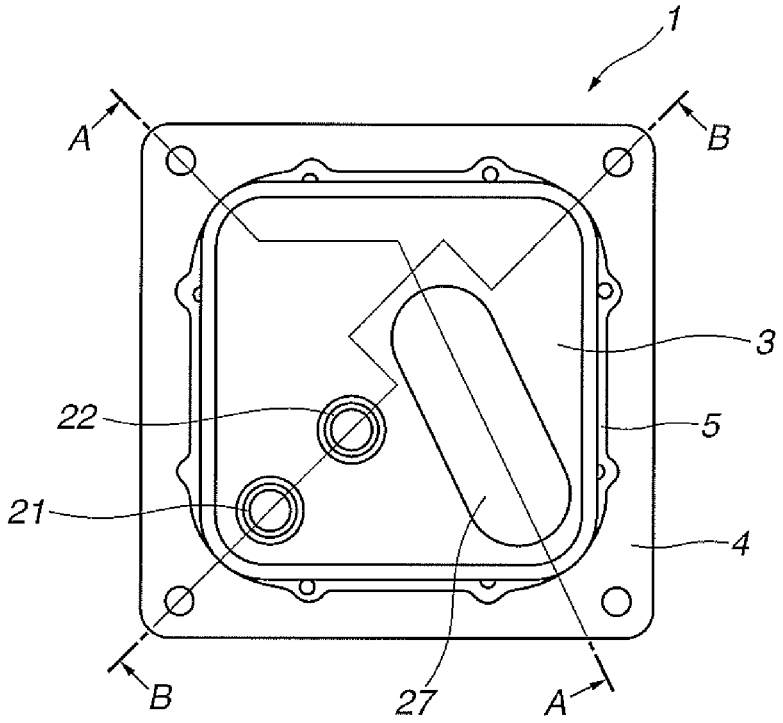
FIG. 2 is a plan view of the oil cooler of the first embodiment of the present invention.

FIG. 1 is an exploded perspective view of a first embodiment of an oil cooler according to the present invention, in which an oil cooler is illustrated by reference numeral 1. In addition, FIG. 2 is a plan view of the oil cooler 1 of the first embodiment. The oil cooler 1 is provided to substantially include: a heat-exchanging section 2 for performing heat exchange between oil and cooling water; a top plate 3 to be attached to the top surface of the heat-exchanging section 2 and having a relatively large thickness; and first and second bottom plates 4, 5 each of which is to be attached to the bottom surface of the heat-exchanging section 2 and has a relatively large thickness.

The heat-exchanging section 2 is configured by laminating a plurality of first core plates 6 and a plurality of second core plates 7 alternately one by one, the first core plates 6 and the second core plates 7 basically having a common shape. Between each of the first core plates 6 and the second core plate 7 adjacent thereto, inter-plate oil flow passages and inter-plate cooling water flow passages are alternately disposed. In the oil cooler 1 of the first embodiment, four inter-plate oil flow passages and three inter-plate cooling water flow passages are provided within the heat-exchanging section 2.

In the illustrated example, each inter-plate oil flow passage is constituted between a lower surface of the first core plate 6 and an upper surface of the second core plate 7 while each inter-plate cooling water flow passage is constituted between an upper surface of the first core plate 6 and a lower surface of the second core plate 7. At each of the inter-plate oil flow passages, an almost square fin plate 8 is provided.

A plurality of first and second core plates 6, 7, the top plate 3, the first and second bottom plates 4, 5 and a plurality of fin plates 8 are brazed to be integral with each other. More specifically, these members are formed of the so-called clad material produced by coating an aluminum alloy base material with a brazing material layer, and therefore brazed integral with each other when heated in a furnace under a state of being provisionally assembled in a given arrangement.

The first core plate 6 located at an uppermost portion of the heat-exchanging section 2 is provided to have a configuration somewhat different from that of the other first core plates 6 located at the midsection of the heat-exchanging section 2 while the second core plate 7 located at a lowermost portion of the heat-exchanging section 2 is provided to have a configuration somewhat different from that of the other second core plates 7, taking the relationship with the top plate 3 or the first and second bottom plates 4, 5 into account.

Figure 3:
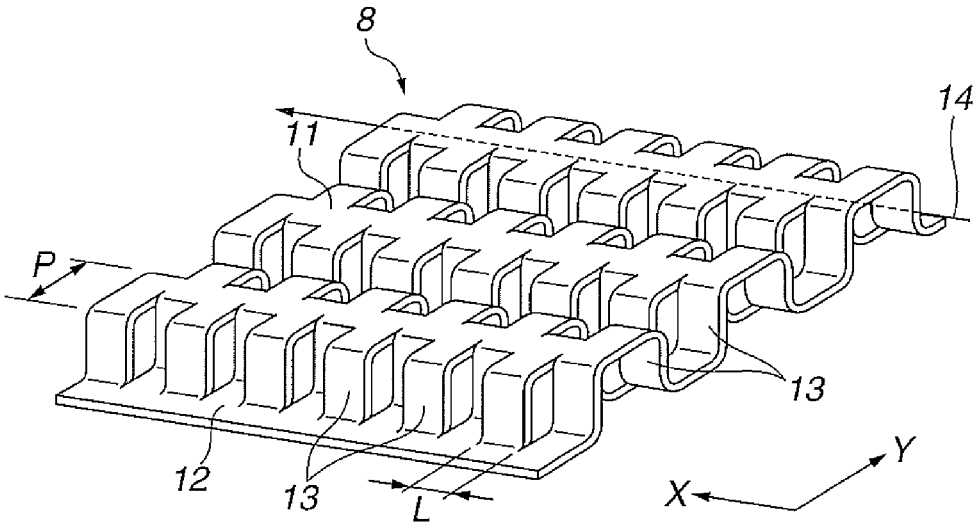
FIG. 3 is an enlarged exploded perspective view of a part of a fin plate.

The fin plates 8 are schematically shown in FIG. 1 but in reality provided to totally have the form of a corrugated fin of an offset type as shown in FIG. 3.

In other words, a fin plate 8 is a corrugated fin formed by bending one sheet of base material to have a rectangular shape or the shape of a latter U with a constant pitch, and more particularly, an offset type corrugated fin where corrugated lines are so aligned as to deviate the positions of the corrugations from each other with a half pitch.

For convenience in explanation, two direction orthogonal to each other in a plan view of the fin plate 8 are respectively defined as the direction of an arrow X and the direction of an arrow Y, as shown in FIG. 3. A base material is subjected to corrugating in such a manner as to be bent toward an opposite direction with a pitch P while being delivered in the direction Y, and also subjected to bending at slits (extending in the direction Y and provided periodically in the direction X to have a width L) at intervals of the width L so as to deviate each line of corrugations with a half pitch.

Hence the fin plate 8 is constituted of: a top wall 11 formed continuous in the direction X even with a zigzag pattern but not continuous in the direction Y; a bottom wall 12 formed continuous in the direction X even with a zigzag pattern but not continuous in the direction Y; and a great number of leg portions 13 connecting the top wall 11 and the bottom wall 12 to each other. Incidentally, the top wall 11 and the bottom wall 12 are substantially the same member. The great number of leg portions 13 forms broken lines each of which extends in the direction X, in which the broken lines are complementary arranged. In other words, the leg portions 13 establish a staggered layout as a whole.

In the state where the fin plate 8 is bonded between the first core plate 6 and the second core plate 7, the top wall 11 is in intimate contact with the first core plate 6 and the bottom wall 12 is in intimate contact with the second core plate 7; therefore in substance the great number of leg portions 13 are to exist as fins for heat exchange between the first core plate 6 and the second core plate 7, and the leg portions 13 are to take on a structure cutting across the inter-plate oil flow passage.

In the case of flowing oil in the direction X, accordingly, oil can flow linearly along an arrow 14 between adjacent lines of leg portions 13, and therefore the flow passage resistance is relatively small. On the contrary, in the case of flowing in the direction Y adjacent lines of leg portions 13 overlap with each other so that the oil cannot flow linearly but flow meanderingly, and therefore the flow passage resistance is relatively large. Namely, the inter-plate oil flow passage has anisotropy in terms of flow passage resistance between the directions X and Y since the fin plate 8 is interposed therein.

The first core plate 6 and the second core plate 7 are obtained by conducting press forming on a thin base material formed of aluminum alloy to have an almost square shape, and formed with three oil pass holes 15 and three cooling water pass holes 16.

In the oil cooler 1 the first core plate 6 and the second core plate 7 are each provided having three oil pass holes 15 and three cooling water pass holes 16. With this arrangement, it becomes feasible to dispose both an oil inlet 17 for introducing oil into the heat-exchanging section 2 and an oil outlet 18 for draining oil out of the heat-exchanging section 2, at a lower end servings as one end part located at one side of the core plate lamination direction, and additionally it becomes possible to provide both a cooling water inlet 19 for introducing cooling water into the heat-exchanging section 2 and a cooling water outlet 20 for draining cooling water out of the heat-exchanging section 2 at an upper end serving as the other end part located at the other side of the core plate lamination direction.

Incidentally, a member illustrated in FIG. 1 by reference numeral 21 is a cooling water inlet pipe connected to the cooling water inlet 19 and a member illustrated in FIG. 1 by reference numeral 22 is a cooling water outlet pipe connected to the cooling water outlet 20.

Figure 4:
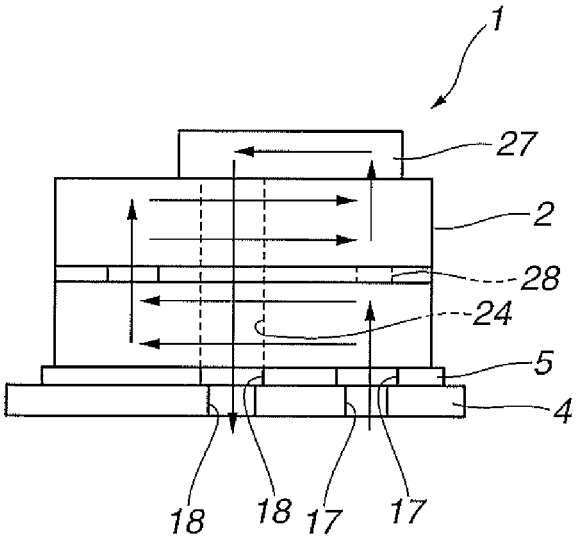
FIG. 4 is an explanatory view schematically showing a cross-section of the oil cooler of the first embodiment, taken along the line A-A of FIG. 2.

The oil pass holes 15 are constituted of: a retreating oil pass hole 25 piercing through the heat-exchanging section 2 in the core plate lamination direction to establish an oil-returning channel 24 (as shown in FIG. 4) communicating with the oil outlet 18; and a pair of advancing oil pass holes 26 formed symmetric with each other with respect to the center of the core plate on a diagonal line of the core plate and located in the vicinity of an outer edge of the core plate.

As shown in FIG. 4, oil introduced from the oil inlet 17 formed in the first and second bottom plates 4, 5 flows inside the heat-exchanging section 2 along a direction perpendicular to the core plate lamination direction while changing its flow direction by a U-turn so as to proceed in the core plate lamination direction as a whole, thereby reaching the uppermost portion of the heat-exchanging section 2. Since the top plate 3 is provided to have a swelling portion 27 with which either one of the pair of advancing oil pass holes 26 and the retreating oil pass hole 25 come to communicate with each other at the uppermost portion of the heat-exchanging section 2, the oil having flowed up to the uppermost portion of the heat-exchanging section 2 is brought into a return trip through the oil-returning channel 24 toward the oil outlet 18 formed in the first and second bottom plates 4, 5. The oil-returning channel 24 is provided to pierce through the heat-exchanging section 2 in the core plate lamination direction.

By the way, a portion illustrated by reference numeral 28 in FIGS. 1 and 4 is an oil blockage portion formed in such a manner as to block one of the pair of advancing oil pass holes 26 of one second core plate 7 located at about midway in the core plate lamination direction.

In the presence of the oil blockage portion 28, the four inter-plate oil flow passages are separated into a group of upper oil flow passages constituted of two upper inter-plate oil flow passages and a group of lower oil flow passages constituted of two lower inter-plate oil flow passages. The group of upper oil flow passages and the group of lower oil flow passages are connected in series, and the inter-plate oil flow passages of each group are connected substantially in parallel with each other. More specifically, by virtue of the presence of the oil blockage portion 28, oil is adapted to change its flow direction rightward or leftward inside the heat-exchanging section 2 by a U-turn thereby proceeding in the core plate lamination direction as a whole.

Figure 5:
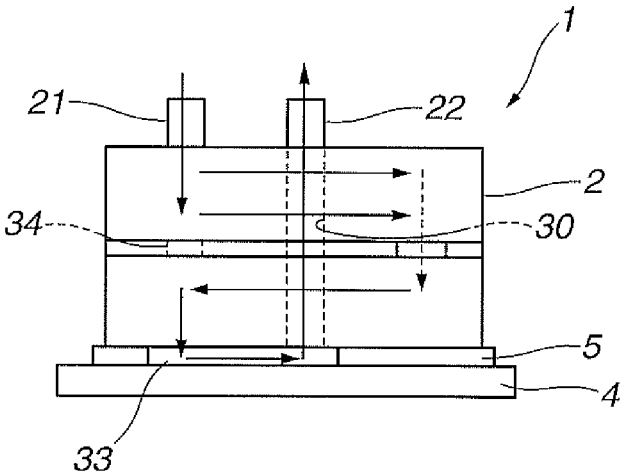
FIG. 5 is an explanatory view schematically showing a cross-section of the oil cooler of the first embodiment, taken along the line B-B of FIG. 2.

The cooling water pass holes 16 are constituted of: a retreating cooling water pass hole 31 piercing through the heat-exchanging section 2 in the core plate lamination direction to establish a cooling water-returning channel 30 (as shown in FIG. 5) communicating with the cooling water outlet 21; and a pair of advancing cooling water pass holes 32 formed symmetric with each other with respect to the center of the core plate on a diagonal line of the core plate and located in the vicinity of an outer edge of the core plate. Incidentally, the diagonal line on which the advancing cooling water pass holes 32 are provided is different from the diagonal line on which the advancing oil pass holes 26 are formed.

As shown in FIG. 5, cooling water introduced from the cooling water inlet 19 formed in the top plate 3 flows inside the heat-exchanging section 2 along a direction perpendicular to the core plate lamination direction while changing its flow direction by a U-turn so as to proceed in the core plate lamination direction as a whole, thereby reaching the lowermost portion of the heat-exchanging section 2. Since the second bottom plate 5 is formed with a communication hole 33 with which either one of the pair of advancing cooling water pass holes 32 and the retreating cooling water pass hole 31 come to communicate with each other at the lowermost portion of the heat-exchanging section 2, the cooling water having flowed down to the lowermost portion of the heat-exchanging section 2 is brought into a return trip through the cooling water-returning channel 30 toward the cooling water outlet 20 formed in the top plate 3. The cooling water-returning channel 30 is provided to pierce through the heat-exchanging section 2 in the core plate lamination direction.

By the way, a portion illustrated by reference numeral 34 in FIGS. 1 and 5 is a cooling water-blockage portion formed in such a manner as to block one of the pair of advancing cooling water pass holes 32 of one first core plate 6 located at about midway in the core plate lamination direction.

In the presence of the cooling water-blockage portion 34, the three inter-plate cooling water flow passages are separated into a group of upper cooling water flow passages constituted of two upper inter-plate cooling water flow passages and a group of lower cooling water flow passage constituted of one lower inter-plate cooling water flow passage. The group of upper cooling water flow passages and the group of lower cooling water flow passage are connected in series, and the inter-plate cooling water flow passages of each group are connected substantially in parallel with each other. More specifically, by virtue of the presence of the cooling water-blockage portion 34, cooling water is adapted to change its flow direction rightward or leftward inside the heat-exchanging section 2 by a U-turn thereby proceeding in the core plate lamination direction as a whole.

The retreating oil pass hole 25 and the retreating cooling water pass hole 31 are disposed at locations offset along at least one flow direction selected from the group consisting of: the mainstream of oil flowing inside the inter-plate oil flow passage from one of a pair of advancing oil pass holes 26 (formed in the core plate 6 or 7) to the other; and the mainstream of cooling water flowing inside the inter-plate cooling water flow passage from one of a pair of advancing cooling water pass holes 32 (formed in the core plate 6 or 7) to the other.

In a plan view of the core plate of the first embodiment, the retreating oil pass hole 25 and the retreating cooling water pass hole 31 are aligned on the diagonal line of the core plate on which a pair of advancing cooling water pass holes 32 are also located, and more specifically, these are disposed at locations offset along the flow direction of the cooling water mainstream. In the plan view of the core plate of the first embodiment, the retreating oil pass hole 25 and the retreating cooling water pass hole 31 are not disposed at locations offset along the flow direction of the oil mainstream.

Moreover, in the first embodiment and in the state where the fin plate 8 is installed inside the inter-plate oil flow passage, the direction X of the fin plate 8 along which the flow passage resistance is relatively small is arranged parallel with either one of two adjacent edges (of the almost square-shaped first and second core plates 6, 7) perpendicular to each other, while the direction Y of the fin plate 8 along which the flow passage resistance is relatively large is arranged parallel with the other of the two adjacent edges (of the almost square-shaped first and second core plates 6, 7) perpendicular to each other. With this arrangement, the retreating oil pass hole 25 and the retreating cooling water pass hole 31 located aligned on a diagonal line of the core plate to be offset along the direction Y of the fin plate 8 where the flow passage resistance is relatively large.

In the first core plate 6, the periphery of each of the advancing oil pass holes 26 is formed into a boss section 35 somewhat protruding toward the inter-plate cooling water flow passage while the periphery of each of the advancing cooling water pass holes 32 is formed into a boss section 38 somewhat protruding toward the inter-plate oil flow passage. Furthermore, in the first core plate 6, the periphery of the retreating oil pass hole 25 is formed into a boss section 36 somewhat protruding toward both the inter-plate cooling water flow passage and the inter-plate oil flow passage, while the periphery of the retreating cooling water pass hole 31 is formed into a boss section 37 somewhat protruding toward both the inter-plate cooling water flow passage and the inter-plate oil flow passage.

In the second core plate 7, the periphery of each of the advancing cooling water pass holes 32 is formed into a boss section 38 somewhat protruding toward the inter-plate oil flow passage, while the periphery of each of the advancing oil pass holes 26 is formed into a boss section 35 somewhat protruding toward the inter-plate cooling water flow passage. Furthermore, in the second core plate 7, the periphery of the retreating oil pass hole 25 is formed into a boss section 36 somewhat protruding toward both the inter-plate cooling water flow passage and the inter-plate oil flow passage, while the periphery of the retreating cooling water pass hole 31 is formed into a boss section 37 somewhat protruding toward both the inter-plate cooling water flow passage and the inter-plate oil flow passage.

Consequently, by combining the first core plate 6 and the second core plate 7 alternately, it becomes possible to keep a certain clearance between the first core plate 6 and the second core plate 7, the clearance serving as the inter-plate cooling water flow passage or the inter-plate oil flow passage.

The boss sections 35 of the first core plate 6 (which boss sections are upwardly projectingly formed at the peripheries of the advancing oil pass holes 26) are respectively joined to the boss sections 35 of the second core plate 7 (which boss sections are downwardly projectingly formed at the peripheries of the advancing oil pass holes 26). With this, two adjacent inter-plate oil flow passages (or a pair of upper and lower inter-plate oil flow passages) come to communicate with each other and divided from the inter-plate cooling water flow passage intervening therebetween. Accordingly, in the state where a number of first and second core plates 6, 7 are assembled, the inter-plate oil flow passages are in communication with each other through a number of advancing oil pass holes 26 so that in the heat-exchanging section 2 oil can flow along the core plate lamination direction as a whole.

The boss sections 38 of the second core plate 7 (which boss sections are upwardly projectingly formed at the peripheries of the advancing cooling water pass holes 32) are respectively joined to the boss sections 38 of the first core plate 6 (which boss sections are downwardly projectingly formed at the peripheries of the advancing cooling water pass holes 32). With this, two adjacent inter-plate cooling water flow passages (or a pair of upper and lower inter-plate cooling water flow passages) come to communicate with each other and divided from the inter-plate oil flow passage intervening therebetween. Accordingly, in the state where a number of first and second core plates 6, 7 are assembled, the inter-plate cooling water flow passages are in communication with each other through a number of advancing cooling water pass holes 32 so that in the heat-exchanging section 2 cooling water can flow along the core plate lamination direction as a whole.

The boss section 36 of the first core plate 6 (which boss section is upwardly and downwardly projected at the periphery of the retreating oil pass hole 25) is joined to the boss section 36 of the second core plate 7 (which boss section is upwardly and downwardly projected at the periphery of the retreating oil pass hole 25). The boss section 37 of the first core plate 6 (which boss section is upwardly and downwardly projected at the periphery of the retreating cooling water pass hole 31) is joined to the boss section 37 of the second core plate 7 (which boss section is upwardly and downwardly projected at the periphery of the retreating cooling water pass hole 31).

The boss section 36 of the second core plate 7 (which boss section is upwardly and downwardly projected at the periphery of the retreating oil pass hole 25) is joined to the boss section 36 of the first core plate 6 (which boss section is upwardly and downwardly projected at the periphery of the retreating oil pass hole 25). The boss section 37 of the second core plate 7 (which boss section is upwardly and downwardly projected at the periphery of the retreating cooling water pass hole 31) is joined to the boss section 37 of the first core plate 6 (which boss section is upwardly and downwardly projected at the periphery of the retreating cooling water pass hole 31).

Therefore, in the state where a number of first and second core plates 6, 7 are assembled, the oil-returning channel 24 and the cooling water-returning channel 30 piercing the heat-exchanging section 2 in the core plate lamination direction are established. The oil-returning channel 24 does not directly communicate with the inter-plate oil flow passages formed between the first core plate 6 and the second core plate 7. The cooling water-returning channel 30 does not directly communicate with the inter-plate cooling water flow passages formed between the first core plate 6 and the second core plate 7.

Moreover, the first core plate 6 and the second core plate 7 are formed with a number of protrusions 43 protruding toward the side of the inter-plate cooling water flow passage.

The fin plate 8 incorporated in the inter-plate oil flow passage is provided having six openings 44 respectively corresponding to the three oil pass holes 15 and the cooling water pass holes 16. The openings 44 are defined to be larger than the three oil pass holes 15 and the cooling water pass holes 16 in diameter so as to allow some margins on the corresponding boss sections 35, 36, 37, 38.

Onto the uppermost portion of the heat-exchanging section 2, the top plate 3 is stacked as discussed above. The top plate 3 is provided including: the cooling water inlet 19 communicating with either one of the pair of advancing cooling water pass holes 32 defined at the uppermost portion of the heat-exchanging section 2; the cooling water outlet 20 communicating with the retreating cooling water pass hole 31 defined at the uppermost portion of the heat-exchanging section 2; and the above-mentioned swelling portion 27.

Onto the lowermost portion of the heat-exchanging section 2, the first bottom plate 4 and the second bottom plate 5 each of which has a sufficient rigidity and a relatively large thickness are stacked as mentioned above. Each of the first bottom plate 4 and the second bottom plate 5 is provided including: the oil inlet 17 communicating with either one of the pair of advancing oil pass holes 26, 26 defined at the lowermost portion of the heat-exchanging section 2; and the oil outlet 18 communicating with the retreating oil pass hole 25 defined at the lowermost portion of the heat-exchanging section 2. The first bottom plate 4 is to be connected to a cylinder block etc. (not shown) at the oil inlet 17 and the oil outlet 18, through a gasket etc. for sealing them (though not shown). Additionally, the first bottom plate 4 is to cover the communication hole 33 formed piercing the second bottom plate 5.

In the oil cooler 1 of the first embodiment, the first and second core plates 6, 7 each are formed to have three oil pass holes 15 and three cooling water pass holes 16, which makes it possible to provide the oil inlet 17 and the oil outlet 18 intensively at one end part in the core plate lamination direction while providing the cooling water inlet 19 and the cooling water outlet 20 intensively at the other end part in the core plate lamination direction. In other words, the oil inlet 17 and the oil outlet 18 may intensively be disposed at the lower end of the oil cooler 1 while the cooling water inlet 19 and the cooling water outlet 20 may intensively be disposed at the upper end of the oil cooler 1. With such an arrangement it becomes possible to enhance the layout flexibility at the time of being mounted on a vehicle.

Furthermore, since oil and cooling water mutually independently flows inside the heat-exchanging section 2 in a direction perpendicular to the core plate lamination direction while changing their flow direction by a U-turn thereby proceeding in the core plate lamination direction as a whole, it becomes possible to ensure an excellent amount of exchanged heat between oil and cooling water with a small number of first and second core plates 6, 7 while keeping their flow velocities from reducing.

In the inter-plate oil flow passage, the smaller the cross-sectional area of an oil mainstream path (which cross section is perpendicular to the oil mainstream) is, the larger the pressure loss becomes during the oil flow. Meanwhile, in the inter-plate cooling water flow passage, the smaller the cross-sectional area of a cooling water mainstream path (which cross section is perpendicular to the cooling water mainstream) is, the larger the pressure loss becomes during the cooling water flow. In view of this fact, the first embodiment of the present invention is configured such that, in a plan view of the core plate, the retreating oil pass hole 25 and the retreating cooling water pass hole 31 are aligned on a diagonal line of the core plate on which the pair of advancing cooling water pass holes 32 are located, and more specifically, these are disposed at locations offset along the flow direction of the cooling water mainstream. With this configuration, in the inter-plate cooling water flow passage, the reduction of the cross-sectional area of the cooling water mainstream path caused by the formation of the retreating oil pass hole 25 and the retreating cooling water pass hole 31 can relatively be suppressed. Namely, concerning the inter-plate cooling water flow passage, it is possible to suppress an increase of pressure loss caused by the formation of the retreating oil pass hole 25 and the retreating cooling water pass hole 31.

Since the advancing oil pass holes 26 and the advancing cooling water pass holes 32 are located in the vicinity of the outer edge of the core plate in a plan view of the core plate, it is possible to inhibit the pressure loss in the inter-plate oil flow passage or the inter-plate cooling water flow passage from increasing.

Moreover, since the retreating oil pass hole 25 and the retreating cooling water pass hole 31 are provided to be offset along the direction Y of the fin plate 8 where the flow passage resistance is relatively large, it is possible to suppress an increase of pressure loss of the inter-plate oil flow passage caused by disposing the fin plate 8 inside the inter-plate oil flow passage.

Incidentally, in the case of giving an anisotropy to the flow passage resistance of the inter-plate cooling water flow passage by providing the first core plate 6 and the second core plate 7 with a number of protrusions 43, the retreating oil pass hole 25 and the retreating cooling water pass hole 31 may be located to be offset in a direction along which the flow passage resistance is increased by the formation of a number of protrusions 43. With this, it is possible to suppress an increase of pressure loss of the inter-plate cooling water flow passage caused by the formation of a number of protrusions 43.

The present invention will hereinafter be discussed with reference to other embodiments, in which the same member as in the above-mentioned first embodiment will be given the same reference numeral, and redundant explanations will be omitted.

Referring now to FIGS. 6 to 9, a second embodiment of the oil cooler according to the present invention will be illustrated by reference numeral 51. The oil cooler 51 of the second embodiment has a generally similar configuration to that in the above-mentioned first embodiment with the exception that the oil inlet 17 and the oil outlet 18 are disposed at the upper end serving as one end in the core plate lamination direction (i.e., a vertical direction) together with the cooling water inlet 19 and the cooling water outlet 20.

Figure 7:
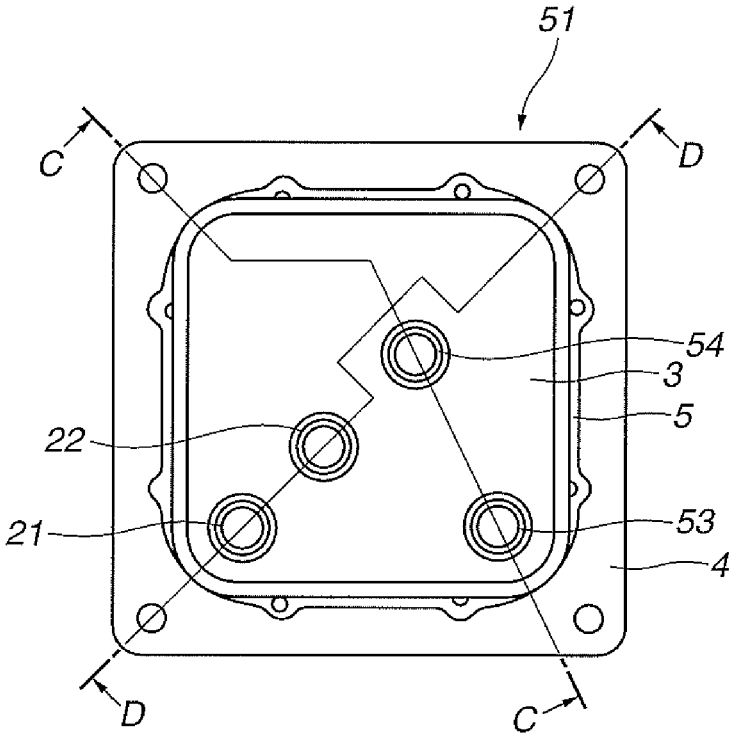
FIG. 7 is a plan view of the oil cooler of the second embodiment of the present invention.

In the second embodiment, the top plate 3 attached to the top surface of the heat-exchanging section 2 is formed to have: the oil inlet 17; the oil outlet 18; the cooling water inlet 19; and the cooling water outlet 20 as shown in FIG. 7.

Additionally, the second bottom plate 5 is formed having: the communication hole 33 with which either one of the pair of advancing cooling water pass holes 32 and the retreating cooling water pass hole 31 come to communicate with each other at the lowermost portion of the heat-exchanging section 2; and a second communication hole 52 for bringing either one of the pair of advancing oil pass holes 26 and the retreating oil pass hole 25 into communication with each other at the lowermost portion of the heat-exchanging section 2. Additionally, the first bottom plate 4 is to cover the communication hole 33 and the second communication hole 52 formed piercing the second bottom plate 5.

Figure 6:
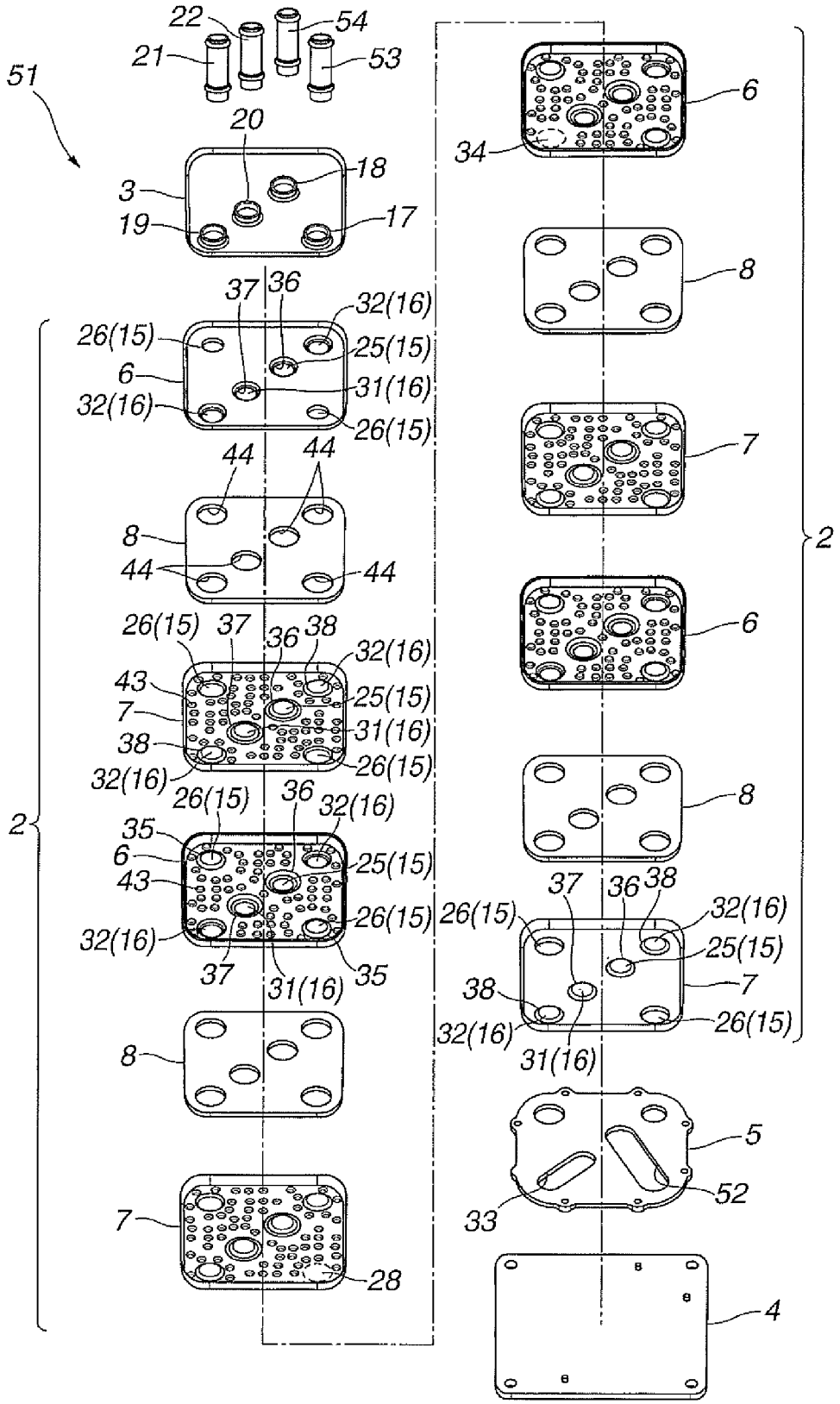
FIG. 6 is an exploded perspective view of a second embodiment of an oil cooler according to the present invention.

A member illustrated by reference numeral 53 in FIG. 6 is an oil inlet pipe to be attached to the oil inlet 17 while a member illustrated by reference numeral 54 in FIG. 6 is an oil outlet pipe to be attached to the oil outlet 18.

Figure 8:
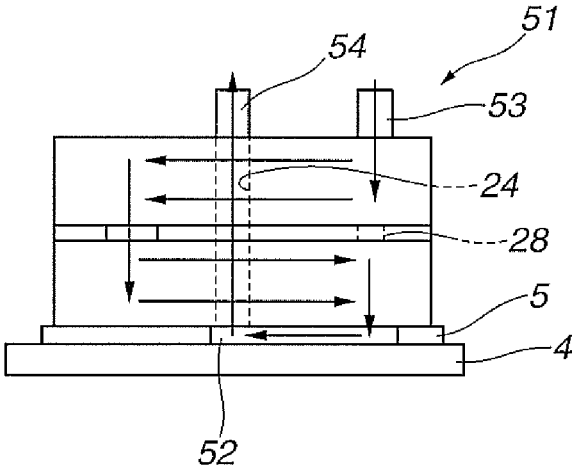
FIG. 8 is an explanatory view schematically showing a cross-section of the oil cooler of the second embodiment, taken along the line C-C of FIG. 7.

As shown in FIG. 8, oil introduced from the oil inlet 17 formed in the top plate 3 flows inside the heat-exchanging section 2 along a direction perpendicular to the core plate lamination direction while changing its flow direction by a U-turn so as to proceed in the core plate lamination direction as a whole, thereby reaching the lowermost portion of the heat-exchanging section 2. Since the second bottom plate 5 is provided to have the second communication hole 52 with which either one of the pair of advancing oil pass holes 26 and the retreating oil pass hole 25 come to communicate with each other at the lowermost portion of the heat-exchanging section 2, the oil having flowed down to the lowermost portion of the heat-exchanging section 2 is brought into a return trip through the oil-returning channel 24 toward the oil outlet 18 formed in the top plate 3. The oil-returning channel 24 is provided to pierce through the heat-exchanging section 2 in the core plate lamination direction.

In the presence of the oil blockage portion 28, the four inter-plate oil flow passages are separated into a group of upper oil flow passages constituted of two upper inter-plate oil flow passages and a group of lower oil flow passages constituted of two lower inter-plate oil flow passages. The group of upper oil flow passages and the group of lower oil flow passages are connected in series, and the inter-plate oil flow passages of each group are connected substantially in parallel with each other. More specifically, by virtue of the presence of the oil blockage portion 28, oil is adapted to change its flow direction rightward or leftward inside the heat-exchanging section 2 by a U-turn thereby proceeding in the core plate lamination direction as a whole.

Figure 9:
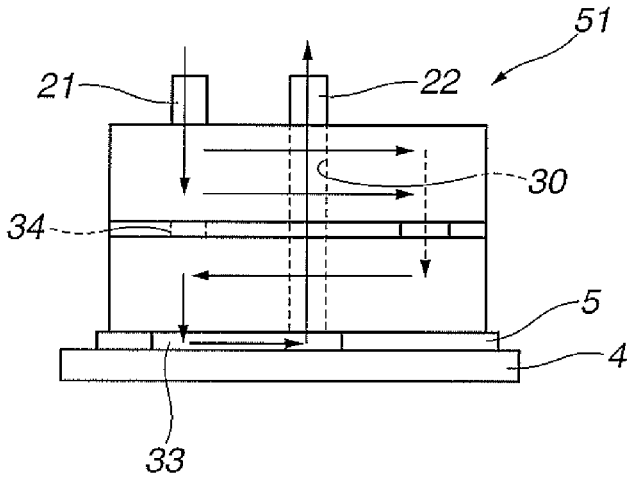
FIG. 9 is an explanatory view schematically showing a cross-section of the oil cooler of the second embodiment, taken along the line D-D of FIG. 7.

As shown in FIG. 9, cooling water introduced from the cooling water inlet 19 formed in the top plate 3 flows inside the heat-exchanging section 2 along a direction perpendicular to the core plate lamination direction while changing its flow direction by a U-turn so as to proceed in the core plate lamination direction as a whole, thereby reaching the lowermost portion of the heat-exchanging section 2. Since the second bottom plate 5 is formed with the communication hole 33 with which either one of the pair of advancing cooling water pass holes 32 and the retreating cooling water pass hole 31 come to communicate with each other at the lowermost portion of the heat-exchanging section 2, the cooling water having flowed down to the lowermost portion of the heat-exchanging section 2 is brought into a return trip through the cooling water-returning channel 30 toward the cooling water outlet 20 formed in the top plate 3. The cooling water-returning channel 30 is provided to pierce through the heat-exchanging section 2 in the core plate lamination direction.

In the presence of the cooling water-blockage portion 34, the three inter-plate cooling water flow passages are separated into a group of upper cooling water flow passages constituted of two upper inter-plate cooling water flow passages and a group of lower cooling water flow passage constituted of one lower inter-plate cooling water flow passage. The group of upper cooling water flow passages and the group of lower cooling water flow passage are connected in series, and the inter-plate cooling water flow passages of each group are connected substantially in parallel with each other. More specifically, by virtue of the presence of the cooling water-blockage portion 34, cooling water is adapted to change its flow direction rightward or leftward inside the heat-exchanging section 2 by a U-turn thereby proceeding in the core plate lamination direction as a whole.

Thus, the almost same effects as in the above-mentioned first embodiment can be obtained also in the second embodiment.

In the above-mentioned first and second embodiments, the flow direction of the oil mainstream and the flow direction of the cooling water mainstream are in parallel with different diagonal lines of the almost square-shaped first and second core plates 6, 7, respectively. Accordingly, if decomposing the flow vectors of oil and those of cooling water into directions of two edges of the first and second core plates 6, 7 which edges are adjacent and perpendicular to each other, the decomposed flow vectors of them should not oppose to each other in the direction of one edge but oppose to each other in the direction of the other edge. In other words, the flow of oil in the inter-plate oil flow passage and the flow of cooling water in the inter-plate cooling water flow passage establish a counterflow to each other, though not a perfect one. In the case where the core plate has a rectangular shape, a decomposed vector serving as the side establishing the counterflow may be oriented parallel with the direction of the longer side, with which the flow of oil in the inter-plate oil flow passage and the flow of cooling water in the inter-plate cooling water flow passage may establish a more perfect counterflow.

The example discussed in the first and second embodiments involves four first core plates 6, four second core plates 7, four inter-plate oil flow passages, and three inter-plate cooling water flow passages. However, the number of each of the first and second core plate 6, 7 is not particularly limited to four and it may be suitably modified, and in other words, the number of each of the inter-plate oil flow passage and the inter-plate cooling water flow passage may suitably be modified.

In the above-mentioned first and second embodiments oil and cooling water each change its flow direction between rightward and leftward inside the heat-exchanging section 2 once and for all by making one U-turn: however, only if suitably blocking either one of the pair of advancing oil pass holes 26 or either one of the pair of advancing cooling water pass holes 32 in a plurality of first and second core plates 6, 7 of suitable positions, it becomes possible to change the flow direction of oil and cooling water between rightward and leftward inside the heat-exchanging section 2 two or more times by a plurality of U-turns thereby delivering the oil and cooling water in the core plate lamination direction as a whole.

The flow direction of oil or cooling water in the heat-exchanging section 2, as discussed in the first and second embodiment may be reversed. More specifically, oil may be introduced from the oil outlet 18 and it may exit from the oil inlet 17, and cooling water may be introduced from the cooling water outlet 20 and it may exit from the cooling water inlet 19.

The retreating oil pass hole 25 and the retreating cooling water pass hole 31 are not limited to the locations as exemplified by the first and second embodiments, and therefore these may be formed at locations as shown in FIGS. 10 to 14, for example. Incidentally, each core plate as illustrated in FIGS. 10 to 14 corresponds to the second core plate 7 of the first and second embodiments.

Figure 10:
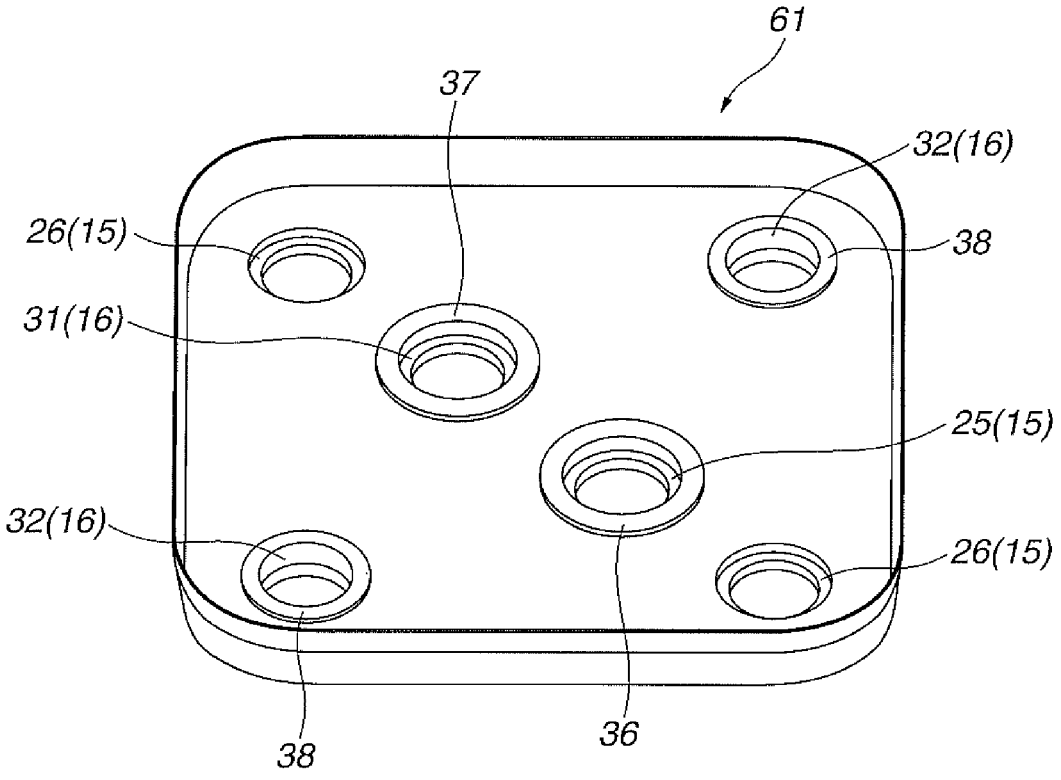
FIG. 10 is a perspective view of a core plate in a further embodiment of an oil cooler.

In a core plate 61 as shown in FIG. 10, the retreating oil pass hole 25 and the retreating cooling water pass hole 31 are aligned on a diagonal line of the core plate on which the pair of advancing oil pass holes 26 are also located in a plan view of the core plate, and formed at locations offset along the flow direction of the oil mainstream. In this example the retreating oil pass hole 25 and the retreating cooling water pass hole 31 are not disposed at locations offset along the flow direction of the cooling water mainstream, in a plan view of the core plate.

In the inter-plate oil flow passage of an oil cooler to which the above-mentioned core plate 61 is used, the reduction of the cross-sectional area of the oil mainstream path caused by the formation of the retreating oil pass hole 25 and the retreating cooling water pass hole 31 can relatively be suppressed. Namely, concerning the inter-plate oil flow passage, it is possible to suppress an increase of pressure loss caused by the formation of the retreating oil pass hole 25 and the retreating cooling water pass hole 31.

Figure 11:
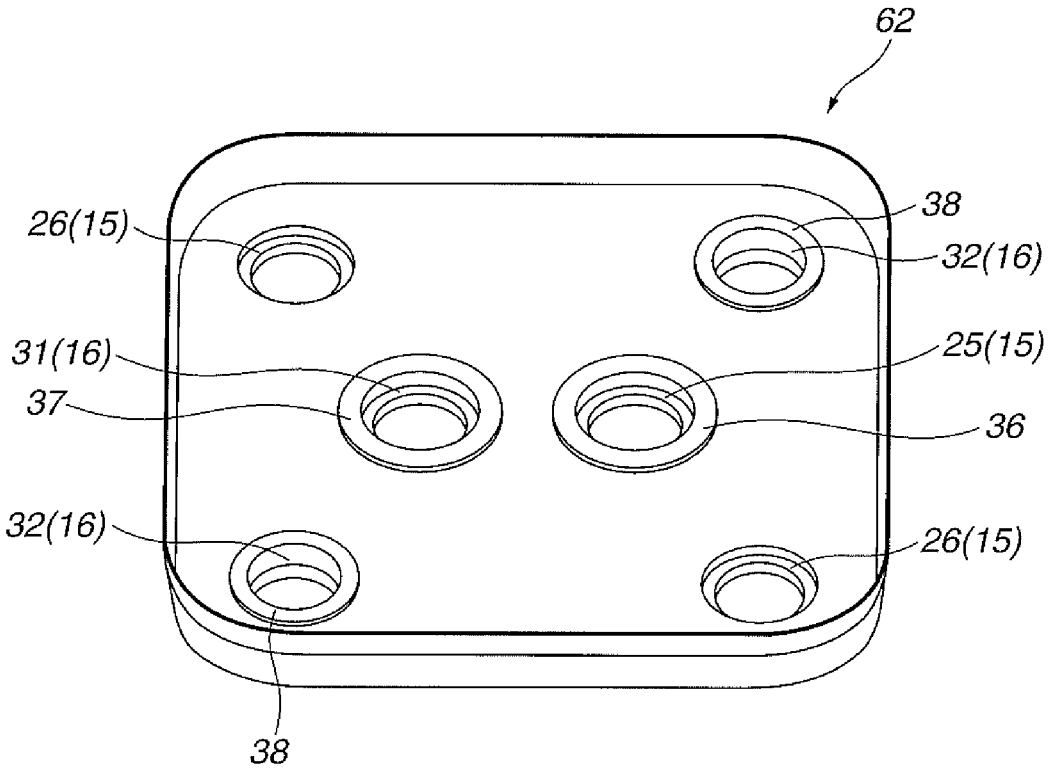
FIG. 11 is a perspective view of a core plate in a still further embodiment of an oil cooler.

In a core plate 62 as shown in FIG. 11, the retreating oil pass hole 25 and the retreating cooling water pass hole 31 are disposed at locations offset along both: the flow direction of the oil mainstream flowing inside the inter-plate oil flow passage from one of the pair of advancing oil pass holes 26 (formed in the core plate 62) to the other; and the flow direction of the cooling water mainstream flowing inside the inter-plate cooling water flow passage from one of the pair of advancing cooling water pass holes 32 (formed in the core plate 62) to the other. In other words, the retreating oil pass hole 25 and the retreating cooling water pass hole 31 are so arranged not to be aligned on the diagonal line of the core plate on which the pair of advancing oil pass holes 26 is disposed and the diagonal line of the core plate on which the pair of advancing cooling water pass holes 32 is disposed, in a plan view of the core plate.

In both the inter-plate oil flow passage and the inter-plate cooling water flow passage of an oil cooler to which the above-mentioned core plate 62 is used, it is possible to suppress an increase of pressure loss caused by the formation of the retreating oil pass hole 25 and the retreating cooling water pass hole 31. Namely, it is possible in the inter-plate oil flow passage to relatively suppress the reduction of the cross-sectional area of the oil mainstream path caused by the formation of the retreating oil pass hole 25 and the retreating cooling water pass hole 31, while it is possible in the inter-plate cooling water flow passage to relatively suppress the reduction of the cross-sectional area of the cooling water mainstream path caused by the formation of the retreating oil pass hole 25 and the retreating cooling water pass hole 31.

Furthermore, in the case of disposing the fin plate 8 in the inter-plate oil flow passage of an oil cooler to which the core plate 62 is employed, the retreating oil pass hole 25 and the retreating cooling water pass hole 31 may be so located as to be offset along the direction Y of the fin plate 8 where the flow passage resistance is relatively large, with which it becomes possible in the inter-plate oil flow passage to suppress an increase of pressure loss caused by disposing the fin plate 8 inside the inter-plate oil flow passage. Particularly if the retreating oil pass hole 25 and the retreating cooling water pass hole 31 are aligned in series along the direction Y of the fin plate 8 where the flow passage resistance is relatively large, an increase of pressure loss caused in the inter-plate oil flow passage by disposing the fin plate 8 inside the inter-plate oil flow passage can be suppressed to maximum.

Figure 12:
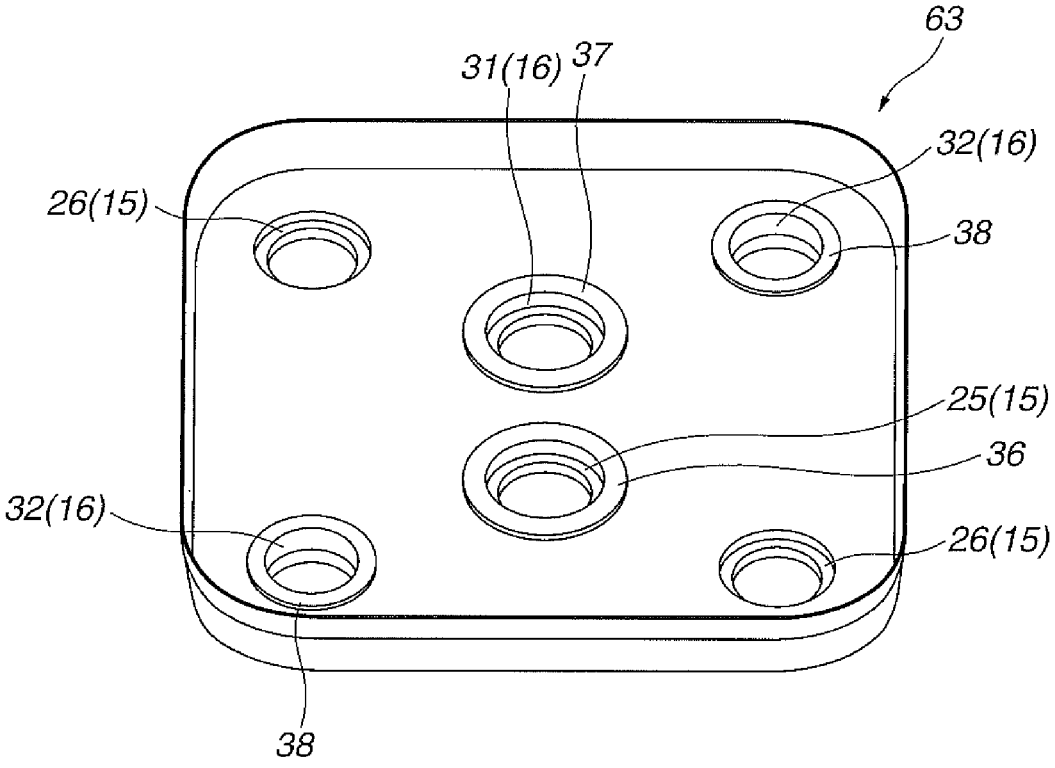
FIG. 12 is a perspective view of a core plate in a still further embodiment of an oil cooler.

In a core plate 63 as shown in FIG. 12, the retreating oil pass hole 25 and the retreating cooling water pass hole 31 are disposed at locations offset along both: the flow direction of the oil mainstream flowing inside the inter-plate oil flow passage from one of the pair of advancing oil pass holes 26 (formed in the core plate 63) to the other; and the flow direction of the cooling water mainstream flowing inside the inter-plate cooling water flow passage from one of the pair of advancing cooling water pass holes 32 (formed in the core plate 63) to the other. In other words, the retreating oil pass hole 25 and the retreating cooling water pass hole 31 are so arranged not to be aligned on the diagonal line of the core plate on which the pair of advancing oil pass holes 26 is disposed and the diagonal line of the core plate on which the pair of advancing cooling water pass holes 32 is disposed, in a plan view of the core plate.

In both the inter-plate oil flow passage and the inter-plate cooling water flow passage of an oil cooler to which the above-mentioned core plate 63 is employed, it is possible to suppress an increase of pressure loss caused by the formation of the retreating oil pass hole 25 and the retreating cooling water pass hole 31. Namely, it is possible in the inter-plate oil flow passage to relatively suppress the reduction of the cross-sectional area of the oil mainstream path caused by the formation of the retreating oil pass hole 25 and the retreating cooling water pass hole 31, while it is possible in the inter-plate cooling water flow passage to relatively suppress the reduction of the cross-sectional area of the cooling water mainstream path caused by the formation of the retreating oil pass hole 25 and the retreating cooling water pass hole 31.

Furthermore, in the case of disposing the fin plate 8 in the inter-plate oil flow passage of an oil cooler to which the core plate 63 is employed, the retreating oil pass hole 25 and the retreating cooling water pass hole 31 may be so located as to be offset along the direction Y of the fin plate 8 where the flow passage resistance is relatively large, with which it becomes possible in the inter-plate oil flow passage to suppress an increase of pressure loss caused by disposing the fin plate 8 inside the inter-plate oil flow passage. Particularly if the retreating oil pass hole 25 and the retreating cooling water pass hole 31 are aligned in series along the direction Y of the fin plate 8 where the flow passage resistance is relatively large, an increase of pressure loss caused in the inter-plate oil flow passage by disposing the fin plate 8 inside the inter-plate oil flow passage can be suppressed to maximum.

Figure 13:
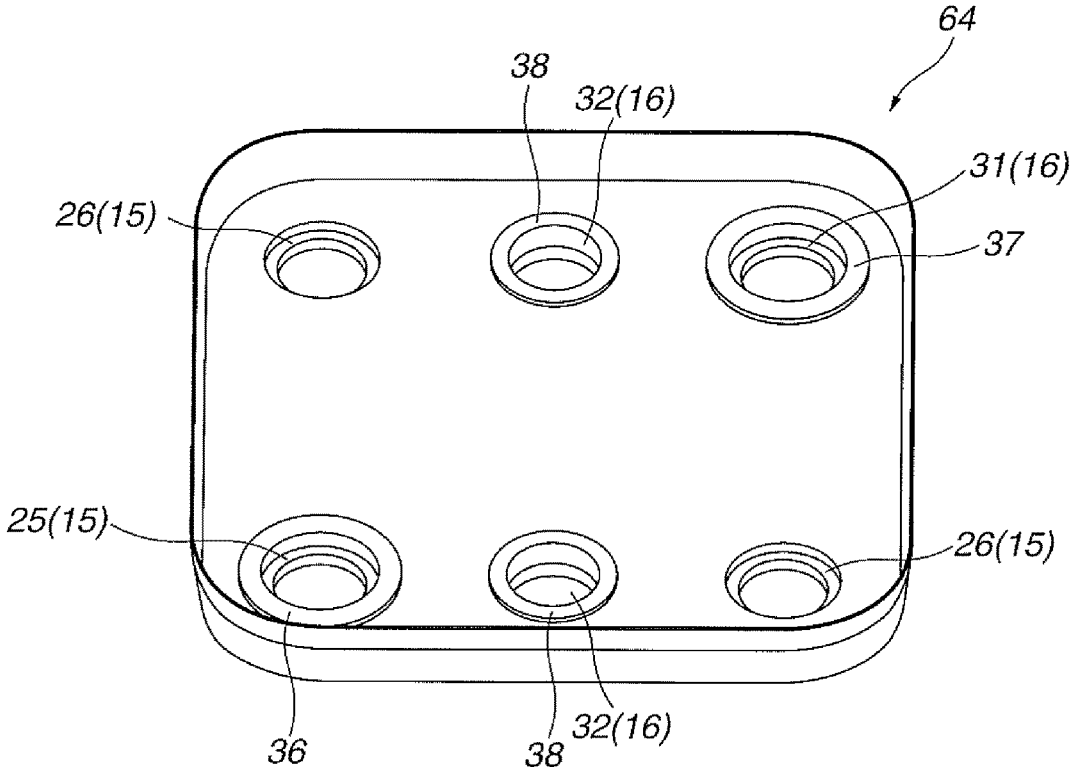
FIG. 13 is a perspective view of a core plate in a still further embodiment of an oil cooler.

In a core plate 64 as shown in FIG. 13, the pair of advancing oil pass holes 26, the pair of advancing cooling water pass holes 32, the retreating oil pass hole 25 and the retreating cooling water pass hole 31 are located in the vicinity of the outer edge of the core plate 64 in a plan view of the core plate.

The pair of advancing oil pass holes 26 is located on a diagonal line of the core plate to be symmetric with each other with respect to the center of the core plate.

The retreating oil pass hole 25 and the retreating cooling water pass hole 31 are located on a diagonal line of the core plate to be symmetric with each other with respect to the center of the core plate.

The pair of advancing cooling water pass holes 32 is formed such that one of them is located between the retreating oil pass hole 25 and one of the pair of advancing oil pass holes 26 while the other is located between the retreating cooling water pass hole 31 and the other of the pair of advancing oil pass holes 26.

In an oil cooler employing the core plate 64, the advancing oil pass holes 26 are located adjacent to the advancing cooling water pass holes 32, respectively. With this, the flow direction of oil in the inter-plate oil flow passage and that of cooling water in the inter-plate cooling water flow passage may become nearly opposed to each other so as to relatively improve cooling efficiency. Additionally, as compared with the case of forming the retreating oil pass hole 25 and the retreating cooling water pass hole 31 at the center of the core plate 64, an increase of pressure loss can be suppressed. In other words, the retreating oil pass hole 25 and the retreating cooling water pass hole 31 are located at the outer edge of the inter-plate oil flow passage and at the inter-plate cooling water flow passage, respectively, thereby having difficulty in inhibiting both the oil mainstream and the cooling water mainstream, so that it becomes possible, in both the inter-plate oil flow passage and the inter-plate cooling water flow passage, to further suppress an increase of pressure loss caused by forming the retreating oil pass hole 25 and the retreating cooling water pass hole 31.

Figure 14:
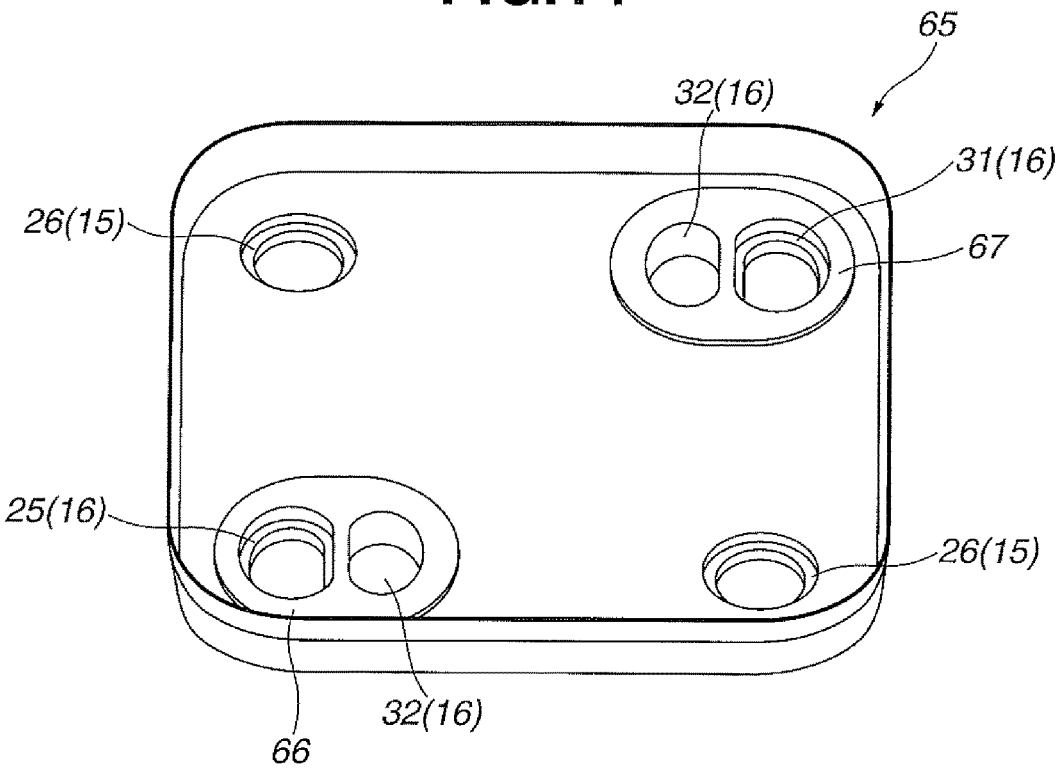
FIG. 14 is a perspective view of a core plate in a still further embodiment of an oil cooler.

In a core plate 65 as shown in FIG. 14, the retreating oil pass hole 25 and the retreating cooling water pass hole 31 are located adjacent to different advancing cooling water pass holes 32, respectively. More specifically, the retreating oil pass hole 25 is formed adjacent to one of the pair of advancing cooling water pass holes 32 while the retreating cooling water pass hole 31 is formed adjacent to the other of the pair of advancing cooling water pass holes 32.

A member illustrated in FIG. 14 by reference numeral 66 is a boss section surrounding the periphery of the retreating oil pass hole 25 and the periphery of the one of the pair of advancing cooling water pass holes 32 and corresponds to the above-mentioned boss sections 36, 38. A member illustrated in FIG. 14 by reference numeral 67 is a boss section surrounding the periphery of the retreating cooling water pass hole 31 and the periphery of the other of the pair of advancing cooling water pass holes 32 and corresponds to the above-mentioned boss sections 37, 38.

In an oil cooler employing the core plate 65, an increase of pressure loss can be suppressed as compared with the case of forming the retreating oil pass hole 25 and the retreating cooling water pass hole 31 at the center of the core plate 65. In other words, the retreating oil pass hole 25 and the retreating cooling water pass hole 31 are located adjacent to different advancing cooling water pass holes 32, respectively, thereby having difficulty in inhibiting both the oil mainstream and the cooling water mainstream, so that it becomes possible, in both the inter-plate oil flow passage and the inter-plate cooling water flow passage, to further suppress an increase of pressure loss caused by forming the retreating oil pass hole 25 and the retreating cooling water pass hole 31.

Although the invention has been described above by reference to certain embodiments and examples of the invention, the invention is not limited to the embodiments and examples described above. Modifications and variations of the embodiments and examples described above will occur to those skilled in the art, in light of the above teachings. For example, the outer shapes of the core plate and the fin plate are not limited to almost square ones (though in the above-mentioned embodiments the core plate and the fin plate each are shaped generally into a square) and therefore these may be circular, ellipsoidal, rectangular or the like. The scope of the invention is defined with reference to the following claims

What is claimed is:

1. An oil cooler comprising:

a plurality of core plates each of which has three oil pass holes where oil flows and three cooling water pass holes where cooling water flows;

a heat-exchanging section where the core plates are laminated to define an interpolate oil flow passage and an inter-plate cooling water flow passage alternately between an adjacent pair of the core plates, so as to permit oil and cooling water to mutually independently flow in a direction perpendicular to a core plate lamination direction while changing a flow direction by a U-turn, thereby proceeding in the core plate lamination direction; and one end part located at one side of the core plate lamination direction, and provided with both an oil inlet for introducing oil into the heat-exchanging section and an oil outlet for draining oil out of the heat-exchanging section and with both a cooling water inlet for introducing cooling water into the heat-exchanging section and a cooling water outlet for draining cooling water out of the heat-exchanging section, wherein the inter-plate oil flow passage and the inter-plate cooling water flow passage are formed between the core plates having both of the three oil pass holes and the three cooling water pass holes, wherein the three cooling water pass holes include a pair of advancing cooling water pass holes and a retreating cooling water pass hole, wherein a first bottom plate and a second bottom plate are attached to a bottom surface of the heat-exchanging section, and the second bottom plate includes a communication hole through which (i) one of the pair of advancing cooling water pass holes and (ii) the retreating cooling water pass hole communicate with each other, and includes a communication hole through which (i) one of the pair of advancing oil pass holes and (ii) the retreating oil pass hole communicate with each other, at a lowermost portion of the heat-exchanging section, and wherein the oil cooler further comprises:

a first intermediate plate comprising a cooling water-blockage portion structured to block one of the pair of advancing cooling water pass holes in the core plate lamination direction; and a second intermediate plate comprising an oil blockage portion structured to block one of a pair of advancing oil pass holes in the core plate lamination direction.

2. An oil cooler comprising:

a plurality of core plates each of which has three oil pass holes where oil flows and three cooling water pass holes where cooling water flows;

a heat-exchanging section where the core plates are laminated to define an interpolate oil flow passage and an inter-plate cooling water flow passage alternately between an adjacent pair of the core plates, so as to permit oil and cooling water to mutually independently flow in a direction perpendicular to a core plate lamination direction while changing a flow direction by a U-turn, thereby proceeding in the core plate lamination direction; and one end part located at one side of the core plate lamination direction, and provided with both an oil inlet for introducing oil into the heat-exchanging section and an oil outlet for draining oil out of the heat-exchanging section and with both a cooling water inlet for introducing cooling water into the heat-exchanging section and a cooling water outlet for draining cooling water out of the heat-exchanging section, wherein the inter-plate oil flow passage and the inter-plate cooling water flow passage are formed between the core plates having both of the three oil pass holes and the three cooling water pass holes, wherein the three cooling water pass holes include a pair of advancing cooling water pass holes and a retreating cooling water pass hole, wherein a first bottom plate and a second bottom plate are attached to a bottom surface of the heat-exchanging section, and the second bottom plate includes a communication hole through which (i) one of the pair of advancing cooling water pass holes and (ii) the retreating cooling water pass hole communicate with each other, and includes a communication hole through which (i) one of the pair of advancing oil pass holes and (ii) the retreating oil pass hole communicate with each other, at a lowermost portion of the heat-exchanging section, wherein the oil cooler further comprises a first intermediate plate comprising a cooling water-blockage portion structured to block one of the pair of advancing cooling water pass holes in the core plate lamination direction; and a second intermediate plate comprising an oil blockage portion structured to block one of a pair of advancing oil pass holes in the core plate lamination direction, wherein the oil pass holes comprises:

a retreating oil pass hole piercing through the heat-exchanging section in the core plate lamination direction to establish an oil-returning channel communicating with the oil outlet; and the pair of advancing oil pass holes formed symmetric with each other with respect to a center of the core plate and located in the vicinity of an outer edge of the core plate in a plan view of the core plate, wherein the cooling water pass holes comprises:

the retreating cooling water pass hole, which pierces through the heat-exchanging section in the core plate lamination direction to establish a cooling water-returning channel communicating with the cooling water outlet; and the pair of advancing cooling water pass holes, which are formed symmetric with each other with respect to the center of the core plate and located in the vicinity of the outer edge of the core plate in a plan view of the core plate, and wherein the retreating oil pass hole and the retreating cooling water pass hole are located adjacent to different advancing oil pass holes or different advancing cooling water pass holes, respectively.

* * * * *